United States Patent [19]

Puckett

[11] 4,307,553

[45] Dec. 29, 1981

[54] SEAM FOR JOINING ROOFING PANELS AND METHOD THEREFOR

[75] Inventor: Hubert L. Puckett, Columbus, Miss.

[73] Assignee: The Ceco Corporation, Oak Brook, Ill.

[21] Appl. No.: 151,942

[22] Filed: May 21, 1980

[51] Int. Cl.[3] ..... E04C 1/34

[52] U.S. Cl. ..... 52/470; 52/520; 52/748

[58] Field of Search ..... 52/520, 460, 465, 469, 52/470, 545, 748, 472, 462

[56] References Cited

U.S. PATENT DOCUMENTS

| | | | |
|---|---|---|---|
| 1,292,960 | 1/1919 | Owens | 52/528 |
| 3,213,583 | 10/1965 | Winski | 52/469 X |
| 3,555,758 | 1/1971 | Schroter | 52/528 X |
| 3,608,267 | 9/1971 | Curran | 52/478 X |
| 3,898,783 | 8/1975 | Matlock et al. | 52/529 |
| 4,009,548 | 3/1977 | Hicks | 52/469 |
| 4,034,530 | 7/1977 | Vallee | 52/520 |
| 4,064,819 | 12/1977 | Fox | 113/55 |
| 4,168,596 | 9/1979 | Yoder, Jr. | 52/462 |
| 4,193,242 | 3/1980 | Vallee | 52/469 |

OTHER PUBLICATIONS

*Superseal,* Advertisement from *Metal Building Review,* Apr. 1978, p. 19.

*Primary Examiner*—Price C. Faw, Jr.
*Assistant Examiner*—Carl D. Friedman
*Attorney, Agent, or Firm*—McDougall, Hersh & Scott

[57] ABSTRACT

The seam joins metal roofing panels of the standing rib type with a water-tight seal. The seam utilizes an integral sealing cap having distal flanges, reentrant flanges and a web which is planar prior to bending. The sealing cap encloses a standing rib joint defined by upstanding flanges each having a plurality of tabs extending therefrom. The web of the cap and the tabs are bent into inverted U-shaped configurations. The tabs are captivated between the reentrant flanges and the bent over web thereby locking the panels together. Sealant carried by the distal flanges is compressed between the same and the upstanding flanges to form a water-tight seal. A method for forming the seam is also provided.

10 Claims, 6 Drawing Figures

SEAM FOR JOINING ROOFING PANELS AND METHOD THEREFOR

BACKGROUND OF THE INVENTION

The instant invention relates generally to the field of locking metal roofing panels together. More specifically, the present invention relates to a new and improved seam formed by bending a sealing cap about standing rib joints of metal roofing panels.

Many different methods of joining roofing panels have been employed. One commonly used method is to form one longitudinal edge of a panel in a configuration designed to captivate the other edge of an adjacent panel. Panels of like configuration are then aligned with the proper side-to-side orientation such that the edge of one panel captivates the adjacent edge of the adjoining panel. Joints are formed by bending or crimping the mating edges together. Such panels, of course, are not symmetrical because different edge configurations are incorporated. Panels of the type here under consideration do not employ a sealing cap.

Other roof panel designs have used symmetrically formed upstanding edge configurations and a sealing cap to join the edges together. Such caps are either clipped over the upstanding edges or bent about the edges to form a joint.

Although various methods for joining roof panels have been employed in the prior art, the problems of creating a water-proof seal and a mechanically secure joint have not been completely overcome. The present invention is directed to overcoming these problems by providing a novel seam formed by bending a sealing cap and adjoining panel edges into a configuration which locks adjacent panels together.

PRIOR ART STATEMENT

The following U.S. Pat. Nos. are representative of prior art structures which do not utilize a sealing cap: Owens, 1,292,960; Schroeter, 3,555,758; Curran, 3,608,267; Matlock, 3,898,783.

The prior art discussed below includes the closest known art relative to this invention which employs a sealing cap to join roofing panels together.

In Fox, U.S. Pat. No. 4,064,819, a cap having an inverted channel cross-section is used to join metal roof panels. The cap disclosed in Fox has a pair of spaced flanges which are bent parallel with respect to the base of the channel to enclose portions of a standing T-rib joint.

Another cap for joining roof sheets is disclosed in Hicks, U.S. Pat. No. 4,009,548. This cap has an inverted V-shape with inwardly disposed edges which snap-lock over dimples punched in vertical walls of roofing panels.

A cap having an inverted U-shape with inwardly upturned edges is used in U.S. Pat. No. 4,168,596 to Yoder. Such a cap is snapped over interlocked panel edges.

SUMMARY OF THE INVENTION

The primary purpose of the invention is to provide a new and novel:

(a) seam for forming a mechanically strong joint and moisture-proof seal between metal roof panels of the standing rib type; and (b) method using a sealing cap for forming a seam between roof panels of the standing rib type.

A sealing cap is defined, prior to bending, by a horizontally disposed planar web, reentrant flanges extending downwardly along the edges of the web, and outwardly and downwardly extending distal flanges adjoining the edges of the reentrant flanges. Strips of sealant are uniformly mounted along the inside walls of the distal flanges. The longitudinal edges of adjacent roof panels form a standing rib joint defined by upstanding flanges with horizontally disposed (prior to bending) terminal flanges adjoining the distal edges of the upstanding flanges.

The sealing cap is placed over the standing rib joint such that the inside surface of the planar web rests upon the terminal flanges. The web portion of the sealing cap and the terminal flanges of the standing rib joint are then deformed such that these members have substantially inverted U-shaped configurations. As thus bent, the terminal flanges are captivated between portions of the web and the reentrant flanges. Also, the strips of sealant are compressed between the upstanding flanges of the roof panels and the distal flanges thereby forming a water-tight seal.

Objects of the present invention, in addition to the primary purposes previously described, include providing the following: a mechanically improved seam joining adjacent metal roof panels together; a seam which is economical to form; an improved water-tight seam joining adjacent roof panels; a seam having a streamlined configuration thereby minimizing wind resistance and enhancing the ability to repel precipitation. Additional advantages of this invention will be apparent from the following portion of the specification.

DETAILED DESCRIPTION

Figure 1:
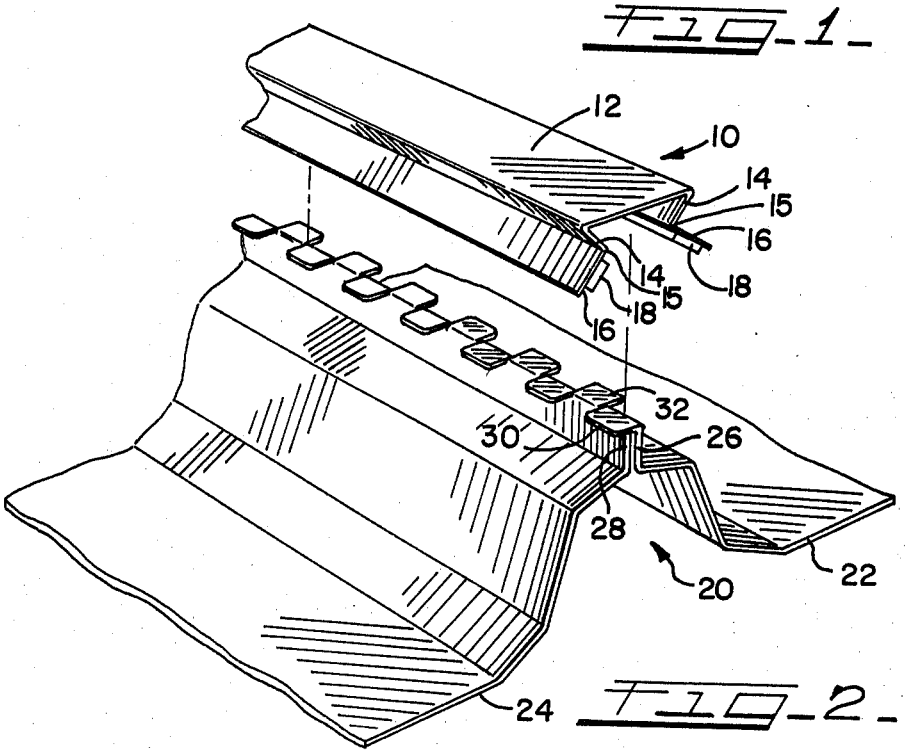
FIG. 1 is an exploded isometric view showing a sealing cap embodying the present invention in position to be placed over a standing rib joint formed by the adjoining edges of identical roof panels.

Referring particularly to FIG. 1, a sealing cap, generally designated 10, includes planar web 12, reentrant flanges 14, distal flanges 16, and sealant strips 18. Inwardly disposed ridges 15 are formed at the junctions of the flanges 14 and 16. Preferably sealing cap 10 is fabricated from a strip of sheet metal. Sealant strips 18, which are mounted on the inside walls of distal flanges 16, are preferably constructed of a resilient material impervious to moisture. By way of example, metal roof panels for which the present invention has particular, although not exclusive, application are disclosed in U.S. Pat. No. 4,168,596, to Yoder, which is assigned to the assignee of the present invention.

Metal roofing panels 22 and 24 form a standing rib joint generally designated 20. The standing rib joint is defined by upstanding flanges 26 and 28 having respective terminal flanges 30 and 32 formed as tabs along the distal edges of the upstanding flanges. In the particular roof panels illustrated in FIG. 1, the tabs 30 and 32 are in alternating interlocking engagement along the entire length of the standing rib joint 20.

Figure 2:
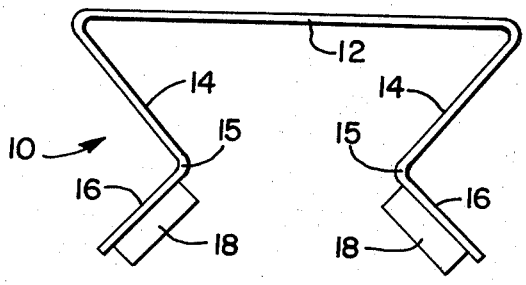
FIG. 2 is an end view of the sealing cap utilized in the present invention.

FIG. 2 shows an end view of sealing cap 10 prior to installation. Sealing cap 10 may be readily formed from a strip of sheet metal by conventional forming or bending techniques. Sealant strips 18 may be bonded to the inside surface of distal flanges 16 either before or after the strip of sheet metal is formed into a sealing cap. The sealant strips have adhesive faces opposite the distal flanges for adhering to upstanding flanges 26 and 28. Masking strips (not shown) can be used to protect the adhesive faces prior to installation.

Figure 3:
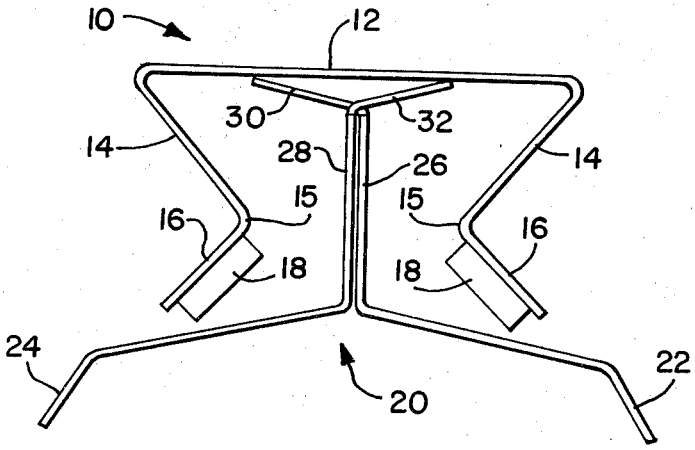
FIG. 3 is an end view showing the sealing cap seated upon a standing rib joint.

Now referring particularly to FIG. 3, sealing cap 10 is shown seated upon standing rib joint 20. The inside wall of web 12 rests on the plurality of tabs 30 and 32 with upstanding flanges 26 and 28 being substantially enclosed by sealing cap 10 as illustrated. The distance between ridges 15 is greater than the total horizontal expanse of tabs 30 and 32, thereby permitting cap 10 to be easily seated as shown in FIG. 3.

Figure 4:
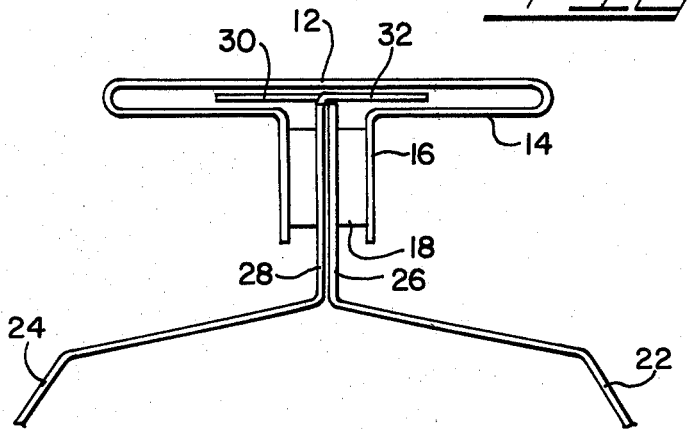
FIGS. 4–6 illustrate the progressive bending of the sealing cap and the terminal flanges of a standing rib joint.
Figure 5:
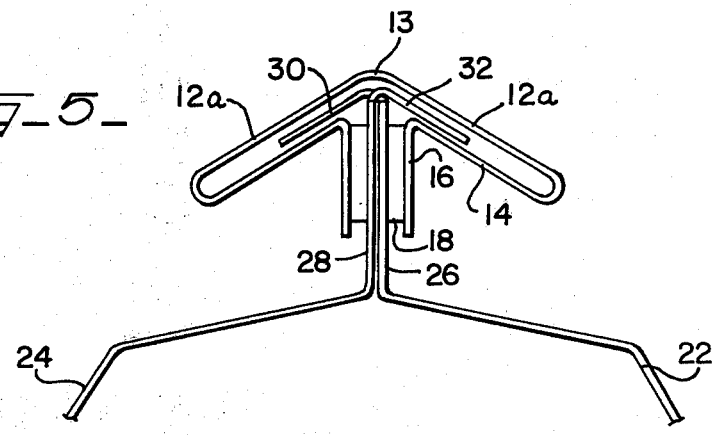
Figure 6:
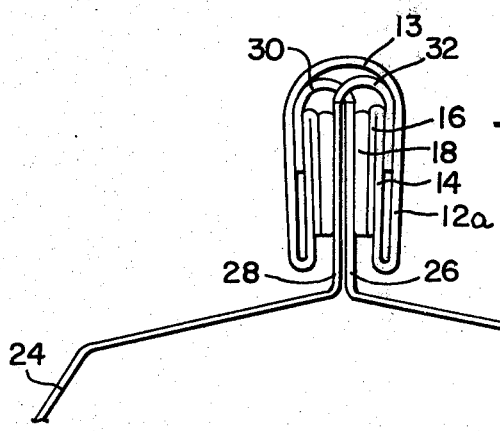

FIGS. 4–6 illustrate the progressive bending of the cap and tabs of the standing rib joint. In FIG. 4, sealing cap 10 is in a substantially T-shaped configuration. Comparing FIG. 4 with FIG. 3, it is seen that distal flanges 16 and reentrant flanges 14 have been bent generally inwardly. Distal flanges 16 are bent to engage sealant strips 18 firmly against upstanding flanges 26 and 28. Reentrant flanges 14 have been bent into parallel spaced relationship with web 12; as a result of this bending, tabs 30 and 32 become enclosed between web 12 and reentrant flanges 14.

FIG. 5 shows an intermediate configuration of the cap and the tabs. Web 12 is now of an inverted V-shape defined by a bight portion 13 and side flanges 12*a*. Tabs 30 and 32 have been bent (compare with FIG. 4) to a further extent. Distal flanges 16 remain in spaced relation to upstanding flanges 26 and 28, and compress sealant strips 18 therebetween. Of course, the included angle defined by flanges 14 and 16 is reduced.

FIG. 6 generally shows sealing cap 10 and tabs 30 and 32 having been bent into final inverted U-shapes. Comparing FIGS. 4, 5 and 6, it will be recognized that originally planar web 12 has been progressively bent into a generally inverted U-shape, as seen in FIG. 6, defined by bight portion 13 and side flanges 12*a*. Side flanges 12*a*, reentrant flanges 14, distal flanges 16, and the end portions of tabs 30 and 32 are all generally vertically disposed. The spaces separating side flanges 12*a* and reentrant flanges 14 have been reduced by this bending thereby securely captivating the ends of tabs 30 and 32 between side flanges 12*a* and reentrant flanges 14 as shown in FIG. 6. Portions of reentrant flanges 14 are pressed against portions of distal flanges 16 thereby compressing sealant strips 18 firmly between upstanding flanges 26 and 28 and the inside surfaces of the distal flanges. Thus, a water-tight seal is effectuated between the sealing cap and upstanding flanges of the standing rib joint. A continuous seam, joining metal roofing panels 22 and 24, is formed by progressively bending sealing cap 10 and tabs 30 and 32 into the configuration shown in FIG. 6 along the length of the standing rib joint. The aforesaid bending is desirably accomplished by a suitable machine. A preferred machine is disclosed in co-pending application, Ser. No. 143,192 filed Apr. 24, 1980, and assigned to the assignee of the present invention.

The mechanical joint, as provided by interlocking tabs 30 and 32 shown in FIG. 6, is enhanced by several factors. The captivation of tabs 30 and 32 between side flanges 12*a* and reentrant flanges 14 forms a mechanically secure seam of unified construction. A force normal to the surface of the upstanding flanges is applied by distal flanges 16 through sealant strips 18; this force provides additional reinforcement to maintain the surfaces of the upstanding flanges in adjacent relationship.

Because no sealant is carried by the roofing panels, no special handling or packaging of the panels is required in order to prevent damage to the sealant. Since the sealing strips used on the current sealing cap are located on the inside walls of the distal flanges, the cap itself acts to protect the sealing strips thereby also minimizing the possibility of damage to the sealant during transit.

The inverted U-shaped configuration presented by the formed seam provides advantages due to this configuration. The streamlined shape of the completed seam minimizes wind resistance. The shape of the completed seam also aids in shedding precipitation and minimizing the accumulation of ice along the standing rib joint.

The cap is symmetrical with respect to its longitudinal center line and is adapted to cooperate with panels which are also symmetrical with respect to their longitudinal center lines. Thus, the present invention contributes substantially to ease in manufacture and assembly.

What is claimed is:

1. A seam for joining roof panels defining a standing rib joint wherein such panels include upstanding flanges having outwardly extending terminal flanges, and wherein a sealing cap is provided, said seam comprising:

(a) said cap having a web, reentrant flanges, and distal flanges;

(b) said web having an inverted U-shape which forms the outer portion of said seam, said web defined by a bight portion and substantially vertical side flanges;

(c) said reentrant flanges adjoining said side flanges in substantial parallel spaced relationship therewith;

(d) said terminal flanges having at least the outer portions thereof captivated between portions of the associated side flanges and reentrant flanges; and (e) said distal flanges being in parallel relationship with both said reentrant flanges and said upstanding flanges and being disposed between such associated reentrant flanges and upstanding flanges.

2. The seam according to claim 1 further comprising a layer of sealant disposed between each of said distal flanges and the adjacent upstanding flange.

3. The seam according to claim 2 wherein the sealant is made of a resilient moisture impervious material which is compressed between each of said distal flanges and the adjacent upstanding flange to provide a waterproof seal.

4. The seam according to claim 1 wherein each of said terminal flanges comprises a plurality of spaced tabs, the tabs of one roof panel being in alternating interlocking engagement with the tabs of the other roof panel.

5. The seam according to claim 1 further defined by being symmetrical about its longitudinal center line.

6. The seam according to claim 1 wherein the reentrant flanges, the terminal flanges and the distal flanges are all bent to lie in substantially vertical planes.

7. The seam according to claim 6 wherein each terminal flange and the adjoining upstanding flange define a configuration of inverted U-shapes.

8. A method for forming a seam between roof panels of the standing rib type wherein such panels are provided with upstanding flanges along longitudinal edges, said upstanding flanges having outwardly extending terminal flanges and wherein a sealing cap is provided, such cap having a web, reentrant flanges, and distal flanges, said method comprising the steps of:

(a) positioning such roof panels in adjoining side-by-side relationship so that the upstanding flanges of the panels are contiguous, (b) positioning the cap over the upstanding flanges and the terminal flanges, and (c) bending the web of the cap into a generally inverted U-shaped configuration, the bending of the web concurrently causing the bending of the terminal and reentrant flanges, whereby the final configuration of the seam is defined by the distal and reentrant flanges disposed between the upstanding flanges and the bent over terminal flange, and portions of the terminal flanges captivated between the reentrant flanges and portions of the bent over web.

9. The method for forming a seam according to claim 8 further comprising the step of bending the distal flanges into adjacent parallel relationship with the upstanding flanges, this bending of the distal flanges concurrently causing the bending of the reentrant flanges adjoined thereto into a substantially parallel spaced relationship with portions of the web, said terminal flanges being enclosed between the web and bent reentrant flanges, this step preceding step (c).

10. The method for forming a seam according to claim 8 wherein said terminal flanges comprise a plurality of alternating tabs which are bent into interlocking relationship during bending step (c).

* * * * *